US005161887A

United States Patent [19]

Goldberg et al.

[11] Patent Number: 5,161,887

[45] Date of Patent: Nov. 10, 1992

[54] PROCESS FOR PRODUCING AN AQUEOUS SOLUTION OF DIFFICULT-TO-DISSOLVE, FINE PARTICLE SIZE PARTICULATE MATERIAL

[76] Inventors: Jeffrey Goldberg, 177 E. Emerson Rd., Lexington, Mass. 02173; Peter Bradshaw, 1340 Lakeview Dr., Green Bay, Wis. 54313

[21] Appl. No.: 771,499

[22] Filed: Oct. 4, 1991

[51] Int. Cl.[5] ..... B01F 13/06

[52] U.S. Cl. ..... 366/139; 366/245

[58] Field of Search ..... 366/139, 150, 154, 155, 366/160, 161, 162, 176, 244, 245, 247, 249; 528/499

[56] References Cited

U.S. PATENT DOCUMENTS

| | | | |
|---|---|---|---|
| 3,425,669 | 2/1969 | Gaddis | 366/154 |
| 3,738,534 | 6/1973 | Abbott | 222/129 |
| 3,782,695 | 1/1974 | Sandiford | 259/4 |
| 3,893,655 | 7/1975 | Sandiford | 259/4 |
| 3,995,839 | 12/1976 | Zingg | 366/154 |
| 4,486,100 | 12/1984 | Endo | 366/139 |
| 4,518,261 | 5/1985 | Sekimoto et al. | 366/150 |
| 4,529,794 | 7/1985 | Sortwell et al. | 528/499 |
| 4,603,156 | 7/1986 | Sortwell | 523/324 |
| 4,640,622 | 2/1987 | Sortwell | 366/76 |
| 4,643,582 | 2/1987 | Ricciardi | 366/154 |
| 4,778,280 | 10/1988 | Brazelton | 366/136 |
| 4,845,192 | 7/1989 | Sortwell et al. | 528/499 |
| 4,874,588 | 10/1989 | Sortwell | 528/499 |

*Primary Examiner*—Robert W. Jenkins

*Attorney, Agent, or Firm*—Marger, Johnson, McCollom & Stolowitz

[57] ABSTRACT

The process comprises first forming a non-homogeneous aqueous mixture of the low solubility particulate material in a closed aqueous solution formation area by combining the low solubility particulate material and water. Next, low shear forces are imparted to the non-homogeneous aqueous mixture of the low solubility particulate material. The aqueous solution of the low solubility particulate material and substantially all of the particulate material dust associated therewith are removed from within the closed aqueous solution formation area by exerting a partial vacuum on the aqueous solution of the low solubility particulate material from outside the formation area. The process can also include the step of imparting the high shear forces to the non-homogeneous aqueous mixture of the low solubility particulate material which both particularizes and conveys at constant volume the low solubility particulate material. In the process of this invention, the aqueous solution of the low solubility particulate material typically contains substantially no undissolved visible particles of the low solubility particulate material.

21 Claims, 1 Drawing Sheet

PROCESS FOR PRODUCING AN AQUEOUS SOLUTION OF DIFFICULT-TO-DISSOLVE, FINE PARTICLE SIZE PARTICULATE MATERIAL

BACKGROUND OF THE INVENTION

This invention relates to a process for producing an aqueous solution of a particulate material having a fine particle size, typically a polymeric particulate material, which is difficult-to-dissolve in water.

The polymeric particulate materials of this invention, such as polyacrylamide, which have a small particle size are very slippery when wetted. This is even more pronounced in materials which have an extremely fine particle size (50 micron or less). Therefore, any spillage or airborne dry polymeric dust due to the use of an "open" system migrates onto areas such as floors, stairways and handrails of a manufacturing facility potentially becoming a great hazard to workers when they become wetted.

Since there are no closed systems for producing solutions of fine micron size versions of the above-described polymers, coarser polymeric particulate materials having much higher relative particle size (250 microns or more) are instead employed in producing solutions of these hard-to-dissolve polymers. A problem associated with these coarser polymeric particulate materials is, however, the length of time it takes them to dissolve them and form a solution. In the formation of polyacrylamide solutions, for example, the intertwined higher molecular weight polymeric chains of the coarser polymeric materials become untangled over time, upon "aging" in water, as the solution reaches its full potency. This aging process requires large tanks for mixing and storing polymer solutions before they can actually be used. Accordingly, the need for including the above-described aging step in the overall solution formation process results in the need for a more costly and a more time consuming manufacturing system in order to produce an aqueous solution in which the polyacrylamide particulate material is substantially completely dissolved.

Complex formation apparatus for forming solutions of the coarser subject materials has also been produced. In U.S. Pat. No. 3,738,534, a vortex chamber is used to provide a hollow cylindrical rapidly flowing film of fluid onto the inner surface of which the polymeric material is introduced. The apparatus of U.S. Pat. No. 3,893,655 includes a vertically mounted wetted wall funnel having a throat of reduced cross-section at the bottom. The particulate solid material is distributed onto the interior surface of the wetted wall funnel and the solids-liquid mixture withdrawn from the funnel and admixed into the liquid flowing past the throat of the funnel. In U.S. Pat. No. 4,518,261, the vessel 201 and the water supply pipe 202 are so constituted that water is whirled within the vessel about the discharge pipe. The water whirled within the circular division plate 205 and discharged from a funnel-shaped discharge pipe 204. The energy and flowing conditions of the water which is whirled while generating negative pressure and discharged from the discharge pipe 204 is normally sufficient to disperse the polymer powder in the water. A particle size reduction apparatus is shown in U.S. Pat. No. 4,529,794, in which a suspension of polymer particles is formed and subjected to conditions of high shear in order to force the particles into solution. The pumping action of an impeller rotating at 10,000 to 13,000 rpm reduces the size of, and dissolves, the polymer particles. In another high shear apparatus described in U.S. Pat. No. 4,603,156, the polymer particles are first comminuted, and the comminuted material and water are fed to a mechanical dispersion means 16. The dispersion means comprises a boxlike housing having an open bottom side, and impeller/stator assembly mounted in the housing. In U.S. Pat. No. 4,778,280, a mixing apparatus is provided having a first centrifugal pump including a casing and an impeller located therein. The casing has an axially extending tubular inlet located centrally on its end wall. The discharge comprises a tubular projection on the sidewall's casing. A second centrifugal pump includes a casing which is substantially identical to the casing of the first pump. The second casing has a tubular projection on its end wall. The water is delivered to one end wall of the second casing. The polymer is directed to the other end wall of the second casing. The swirling water in the second casing creates a lower pressure at its discharge to draw the polymer downwardly and into the first casing where it is mixed with the incoming water.

Therefore a need exists for a process for producing an aqueous solution of a difficult-to-dissolve, fine particle size particulate material, typically a polymeric particulate material, wherein aging time is substantially reduced and in which spillage or airborne dry polymeric dust is eliminated.

SUMMARY OF THE INVENTION

The above-described existing needs have been met by the present invention which provides a process for producing an aqueous solution of a difficult-to-dissolve, fine particle size particulate material, typically a polymeric particulate material, such as polyacrylamide, wherein aging time is substantially reduced and in which spillage or airborne dry polymeric dust is eliminated.

More specifically, a process is provided for producing an aqueous solution of a low solubility, substantially dry particulate material. This is accomplished in a substantially reduced time period and without releasing substantial amounts of particulate dust to the surrounding atmosphere. The aqueous solution produced also contains substantially no undissolved visible particles of said low solubility particulate material.

The process comprises first forming a non-homogeneous aqueous mixture of the low solubility particulate material in a closed aqueous solution formation area by combining the low solubility particulate material and water. The prior art systems for producing homogeneous aqueous mixtures form low solubility particulate material requires the particle size of that material to be 250 microns or greater. The low solubility particulate material preferably has a low particle size of not more than about 150 microns, more preferably a low particle size of not more than about 100 microns, and most preferably a low particle size of not more than about 50 microns.

Next, low shear forces are imparted to the non-homogeneous aqueous mixture of the low solubility particulate material. In this way, homogeneous aqueous solution of the low solubility particulate material are produced containing substantially no undissolved visible particles of the low solubility particulate material. This is accomplished without substantially reducing the particle size of the particulate material beyond the level set forth above.

The aqueous solution of the low solubility particulate material and substantially all of the particulate material dust associated therewith are removed from within the closed aqueous solution formation area. This is done by exerting a partial vacuum on the aqueous solution of the low solubility particulate material from outside the formation area.

The process can also be conducted in a substantially reduced amount of time measured from the formation of the non-homogeneous aqueous mixture of the low solubility particulate material. Typically this reduced amount of time is not more than about 25%, and preferably not more than about 50%, of time period for producing an aqueous solution of low solubility particulate material from a homogeneous aqueous suspension which does not impart the high speed, low shear forces.

The process of claim can also include the step of imparting the high shear forces to the non-homogeneous aqueous mixture of the low solubility particulate material which both particularizes and conveys at constant volume the low solubility particulate material. Preferably, the high shear forces are imparted to the non-homogeneous aqueous mixture of the low solubility particulate material employing a constant volume positive displacement pump. The high shear forces which are imparted to the non-homogeneous aqueous mixture of the low solubility particulate material, are preferably at a rate of at least about 500 rpm. The process of the present invention can also include the step of agitating the aqueous suspension of the low solubility particulate material, without introducing any further amounts of the low solubility particulate material or water, to form the aqueous solution of the low solubility particulate material containing substantially no undissolved visible particles of the low solubility particulate material.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
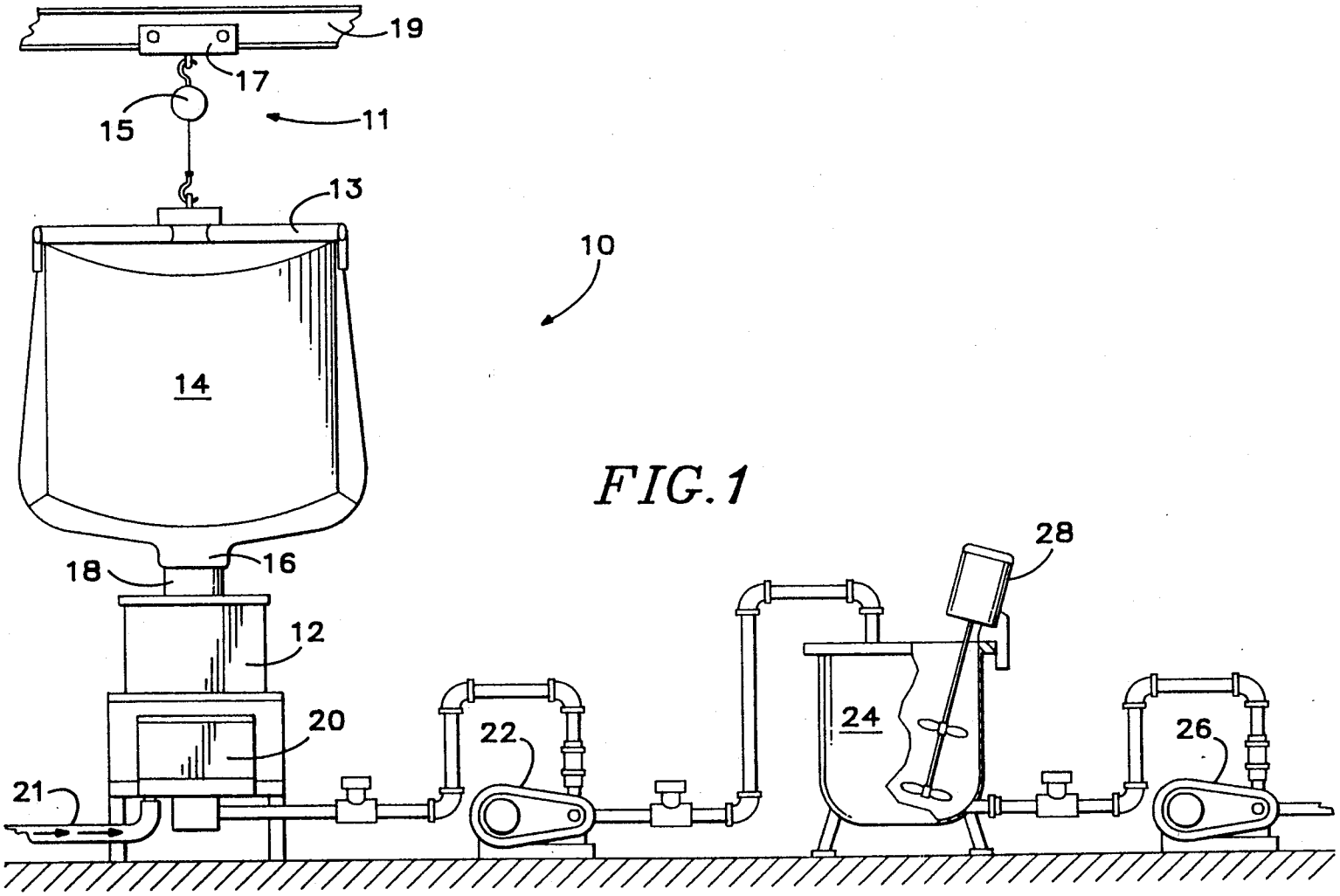
FIG. 1 is a schematic diagram of a preferred process for producing a solution of a fine particle size low solubility.

Referring now to FIG. 1, the feed system 10 of this invention substantially eliminates the aforementioned particulate dust which emanates into the atmosphere from the dry, fine particle size particulate material of the present invention when a feed system open to the atmosphere is employed. The particulate material is typically a polymeric material which has a low degree of solubility in water. Particulate materials for which this process is useful includes polyacrylamide, carboxymethylcellulose, guar gum, carbopol, and various other final particle size particulate materials used in cosmetics, papermaking, and pharmeceuticals, the polyacrylamide particulate material being the preferred composition. This polyacrylamide material can be of an anionic, cationic or nonionic type, having a charge level ranging from very low to very highly, and having a molecular weight ranging from a relatively low molecular weight (about three million) to a very high molecular weight material (greater than 15 million). This material can expand upon aging in water. A typical viscosity for a 5% by weight solution of the material, measured with a Brookfield viscometer using a #2 spindle rotating at 20 rpm and 70° F., is up to about 30,000 to 50,000 cps. An example of this type of material is an polyacrylamide resin manufactured by Allied Colloids of Sulfolk, Va. under the trademark PERCOL. The average particle size of the low solubility particulate material employed herein is in general not more than about 250 microns, preferably not more than about 100 microns, and more preferably not more than about 50 microns.

The solution make-up unit of the present invention is closed to avoid the introduction of the particulate dust into the atmosphere surrounding the equipment. Therefore, the dry, fine particle size particulate material is poured and weighed in a closed system without releasing particulate dust to the atmosphere. In this case, metering of the particulate material is provided using an auger feeder system which delivers a predetermined amount of the material, from about 1–20 lbs/minute, over a set amount of time, about 3–20 minutes/batch. This auger feeder system can be one of a number of units such as the Model No. 602 or 610 manufactured by Accurate Corporation of Whitewater, Wis. A linear adjustment feature in the auger feeder system permits the user to deliver accurately predetermined amounts of the particulate material from the auger feeder.

The particulate material is introduced into the auger feeder from a large (800 to 2400 pounds) sealed bag 14 using a special hopper top accessory 11 assembly available from Accurate Corporation. The special hopper top assessory 11 includes a lifting cross, connected to the bag 14, which is attached to a hoist 15. Hoist 15 is attached to trolley 17 which is movable along I-beam 19. The sealed bag is never directly open to the atmosphere. The bag used is available from companies such as TAY, Inc of Plasticiel, SA, of Monterey, Mexico. The large sealed bag includes a tube 16 which unfolds and extends from beneath the lower portion of the bag. The tube 16 is tied about its end portion to prevent the particulate material from flowing out of the lower end of the tube into the atmosphere. The tube is 8 inches in diameter and fits into a "hoper adaptor" 18 available from Accurate Corporation. The lower end of the tube 16 is inserted into the hopper adaptor 18 and the cord is untied from about the tube. This allows the particulate material to flow from within the bag 14, out of the lower end of the tube, and into the auger feeder 12 through the hopper adaptor 18. When a bag has been emptied, the cord is retied to prevent any residual polymer from spilling out of the tube end, or from dust getting into the air. The empty big bag is disposed of at a landfill or by incineration.

The particulate material exits the lower end of the auger feeder 12 and enters a mixing vessel including a hollow central mixing chamber 20. A stream of water flow 21 (see arrows) is also introduced to the confines of the mixing chamber 20, and a non-homogeneous, aqueous mixture of the low solubility, particulate material. The water stream moves in a swirling manner within the confines of the mixing chamber. This swirling action is facilitated by a high speed, low shear mixing pump 22 operating as hereinafter described. The weight % of the particulate material in the non-homogeneous, aqueous mixture of the low solubility, particulate material is generally from about 0.5 to 10 weight %, preferably from about 1 to 5 weight %. The mixing vessel is covered to provide assistance in preventing particulate dust from escaping into the atmosphere. The material is subsequently further diluted with water in an agitated mixing tank to a solution from about 0.1 to 0.5 weight %.

A significant feature of this invention is the manner in which the system is configured to remove particulate material from within the mixing vessel, including any dust formed within the confines of the mixing chamber 20. More specifically, a high speed, low shear mixing pump 22 is connected at the exit portion of the mixing vessel, in communication with the mixing chamber 20 and the stream of a non-homogeneous, aqueous mixture of the low solubility, particulate material flowing therewith. The stream of a non-homogeneous, aqueous mixture of the low solubility, particulate material is drawn from within the mixing chamber 20 by the high speed mixing pump 22. The mixing pump 22 creates a partial vacuum by operating at a higher throughput rate than operating rate of the respective particulate material and water stream entering the mixing chamber. Any dust located within the confines of the mixing vessel is removed from the mixing chamber and through the mixing pump by exerting a partial vacuum thereon.

The high speed mixing pump described above preferably comprises a gear pump, such as a gear pump manufactured by Bowie Evaporation, or the Model No. H124 or HL125 gear pumps manufactured by Viking Corporation. Some of the particulate materials can be corrosive to the surface areas of the pump. Therefore, fabricating the pump out of hardened steel is the preferred product for greatest longevity. It has also been found that in the Viking pumps the bushing and pin on which it rotates fail in less than 100 hours of operation unless tungsten carbid parts are used. It has also been discovered that the Bowie pump with its greater sized tolerances and lower rpm will achieve over 1,000 hours of operation without need of repair or replacement. The Bowie pump, however, requires the system to have lower agitation and production time prior to using the product than required by the Viking pump. One can expect no more than 500 hours of operation from the Viking pump even with hardened steel gears and tungsten carbide bushings, before replacement parts are needed. It was also discovered that motorized valves as opposed to check valves extend the life of the gear pumps used as no back pressure is created.

The high speed mixing pump is operated at an rpm level which will create a partial vacuum on the mixing chamber, and at the same time will thoroughly mix the water and particulate material. Generally, the high speed mixing pump is operated at a level of at least about 500 rpm. This high relative pump speed mixes the water and particulate material thoroughly so that it is virtually a solution when leaving the pump, and is at full potency and fully aged within minutes. The rpm of the pump during the mixing operation is therefore maintained at a level which does not result in substantial further particularization of the particulate material. For example, if the particulate material is a polymer, the mixing pump is operated so as to avoid substantial shearing of any long chain polymeric materials which would decrease molecular weight, and significantly reduce effectiveness, of the final solution.

The solution of particulate material is pumped from a high speed, low shear mixing pump to holding tank 24. A solution of the polymer at a total solids of between 2–6% active polymer by weight can be formulated in a holding tank. Alternatively, a batch tank can be used to ensure that an exact amount of water is added to the known amount of polymer (from timer on auger) so that a solution strength is constant. This solution strength is ensured because the auger works on a timer and a fixed amount of water is added. In batching situations, solutions between 0.1 to 0.5 weight % are generally produced.

An alternative procedure for an automatic solution formation process is as follows:

If the polymer in the feed tank 24 is consumed so its level falls below a predetermined minimum level point, it is sensed by a probe. One probe which can be which is Model #2470 manufactured by Princo Instrument Corporation of Southampton, Pa. When a signal from the probe is sent to a controller on the mix tank, a batch of polymer is transferred to the feed tank. When a predetermined low level is sensed in the mix tank, an electrical signal is transmitted to a control box which initiates the following series of operations.

1. The transfer pump 26 to the feed tank is shut off.
2. A solenoid valve is opened and water is introduced into the batch tank.
3. Water enters and is moved through a mix cone.
4. The agitator starts to turn in the batch tank.

This process continues until the water level in the batch tank reaches the next sensing level called "polymer level". At this point an auger starts to turn and polymer is delivered to the mix cone. The auger continues to run for a predetermined period of time. This is accomplished by presetting the desired number of minutes on a timer to deliver the desired amount of polymer which is transferred to the batch tank at a known feed rate. Water continues to be introduced into the batch tank from two sources (1) the mix cone (with polymer) and (2) a separate fill line.

After the timer has run for its preset length of time, it shuts off the auger and polymer and, after a 3 second delay, it shuts off the water to the mix chamber and mix pump. Water continues to fill the batch tank from the fill line until the water reaches the fill level on the probe where it sends a signal to the control panel which:

1. Shuts off the solenoid valve sending water through the fill line, and
2. Shuts off the agitator after a short time delay.

The polymer will remain in the batch tank until the probe in the feed tank again signals the control panel for another batch of polymer to be sent. The amount of water required to fill the batch tank and the amount of polymer delivered by the auger over the preset time period, allows for a polymer solution to be produced at between 0.01% to 5% polymer total solids.

In the case of the polymer going directly to the truck-solution strength is determined by water flow (pressure gage through fixed orifice or water meter). In this system constant human monitoring of polymer make up is performed to ensure there is no drop or rise) in water pressure which would change polymer concentration. With batch make up human monitoring is not necessary because a drop in water pressure simply means batch tank takes longer to fill. An agitator 28 on the batch tank blends water and polymer solution so that there is no stratification. Agitation is not needed for mixing. As soon as all water is in batch tank agitator shuts off.

Throughout the system the automatic probes not only turn on and off pumps, valves and mixers, they also alert operators of problems through alarms.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A process for producing an aqueous solution of a low solubility, substantially dry particulate material, in a substantially reduced time period, without releasing substantial amounts of particulate dust to the surrounding atmosphere, the aqueous solution containing substantially no undissolved visible particles of the low solubility particulate material, which comprises forming a non-homogeneous aqueous mixture of said low solubility particulate material in a closed aqueous solution formation area by combining said low solubility particulate material and water;

imparting low shear forces to said non-homogeneous aqueous mixture of said low solubility particulate material thereby producing a homogeneous aqueous solution of said low solubility particulate material containing substantially no undissolved visible particles of said low solubility particulate material, without substantially reducing the particle size of said particulate material, in a reduced amount of time; and removing said aqueous solution of said low solubility particulate material and substantially all of said particulate material dust associated therewith from within said closed aqueous solution formation area, by exerting a partial vacuum on said aqueous solution of said low solubility particulate material from outside said formation area, said substantially reduced time period, which is measured from the formation of said non-homogeneous aqueous mixture of said low solubility particulate material to the formation of said aqueous solution of said low solubility particulate material, being not more than 50% of time period for producing said aqueous solution of said low solubility particulate material from a homogeneous aqueous suspension which does not impart said high speed, low shear forces.

2. The process of claim 1, wherein said low solubility particulate material has a low particle size of not more than about 150 microns.

3. The process of claim 1, wherein said low solubility particulate material comprises polyacrylamide.

4. The process of claim 1, which further includes the step of imparting high shear forces to said non-homogeneous aqueous mixture of said low solubility particulate material which both particularizes and conveys at constant volume said low solubility particulate material.

5. The process of claim 1, wherein high shear forces are imparted to said non-homogeneous aqueous mixture of said low solubility particulate material employing a constant volume positive displacement pump.

6. The process of claim 1, wherein high shear forces are imparted to said non-homogeneous aqueous mixture of said low solubility particulate material at a rate of at least about 500 rpm.

7. The process of claim 1, which further includes the step of agitating said aqueous suspension of said low solubility particulate material, without introducing any further amounts of said low solubility particulate material or water, to form said aqueous solution of said low solubility particulate material containing substantially no undissolved visible particles of said low solubility particulate material.

8. A process for producing an aqueous solution of a low particle size, low solubility particulate material, in a substantially reduced time period, said aqueous solution containing substantially no undissolved visible particles of said low solubility particulate material, which comprises forming a non-homogeneous aqueous mixture of said low particle size, low solubility particulate material at a predetermined substantially constant volumetric ratio of said low solubility particulate material to water, said particulate material having an average particle size of not greater than 150 microns;

imparting high shear forces to said non-homogeneous aqueous mixture of said low particle size, low solubility particulate material, thereby producing a homogeneous aqueous suspension of said low particle size, low solubility particulate material, having said predetermined substantially constant volumetric ratio of said low solubility particulate material to water; and forming said aqueous solution of said low solubility particulate material containing substantially no undissolved visible particles of said low solubility particulate material.

9. The process of claim 8, wherein said substantially reduced time period, measured from forming said non-homogeneous aqueous mixture of said low solubility particulate material, being not more than 50% of time period for producing said aqueous solution of said low solubility particulate material from a homogeneous aqueous suspension which does not have said predetermined substantially constant volumetric ratio of said low solubility particulate material to water.

10. The process of claim 8, wherein said low solubility particulate material comprises polyacrylamide.

11. The process of claim 8, which further includes the step of imparting said high shear forces to said non-homogeneous aqueous mixture of said low solubility particulate material which both particularizes and conveys at constant volume said low solubility particulate material.

12. The process of claim 8, wherein said high shear forces are imparted to said non-homogeneous aqueous mixture of said low solubility particulate material employing a constant volume positive displacement pump.

13. The process of claim 8, wherein said high shear forces are imparted to said non-homogeneous aqueous mixture of said low solubility particulate material at a rate of at least about 500 rpm.

14. The process of claim 8, which further includes the step of agitating said aqueous suspension of said low solubility particulate material, without introducing any further amounts of said low solubility particulate material or water, to form said aqueous solution of said low solubility particulate material containing substantially no undissolved visible particles of said low solubility particulate material.

15. A process for producing an aqueous solution from a low solubility, substantially dry particulate material, in a substantially reduced time period, said aqueous solution containing substantially no undissolved visible particles of said low solubility particulate material, which comprises forming a non-homogeneous aqueous mixture of said low solubility particulate material, said aqueous solution having a predetermined substantially constant in-line volumetric ratio of said low solubility particulate material to water;

imparting high shear forces to said non-homogeneous aqueous mixture of said low solubility particulate material thereby producing a homogeneous aqueous suspension having said predetermined substantially constant in-line volumetric ratio of said low solubility particulate material to water; and agitating said aqueous solution of said low solubility particulate material containing substantially no undissolved visible particles of said low solubility particulate material, without introducing any further amounts of said low solubility particulate material or water, to form said aqueous solution of said low solubility particulate material containing substantially no undissolved visible particles of said low solubility particulate material.

16. The process of claim 15, wherein said low solubility particulate material has a low particle size of not more than about 100 microns.

17. The process of claim 15, wherein said substantially reduced time period, measured from forming said non-homogeneous aqueous mixture of said low solubility particulate material, being not more than 50% of time period for producing said aqueous solution of said low solubility particulate material from a homogeneous aqueous suspension which does not have said predetermined substantially constant volumetric ratio of said low solubility particulate material to water.

18. The process of claim 15, wherein said low solubility particulate material comprises polyacrylamide.

19. The process of claim 15, which further includes the step of imparting said high shear forces to said non-homogeneous aqueous mixture of said low solubility particulate material which both particularizes and conveys at constant volume said low solubility particulate material.

20. The process of claim 15, wherein said high shear forces are imparted to said non-homogeneous aqueous mixture of said low solubility particulate material employing a constant volume positive displacement pump.

21. The process of claim 15, wherein said high shear forces are imparted to said non-homogeneous aqueous mixture of said low solubility particulate material at a rate of at least about 500 rpm.

* * * * *